US007482892B2

(12) United States Patent
Tsai et al.

(10) Patent No.: US 7,482,892 B2
(45) Date of Patent: Jan. 27, 2009

(54) TRAVELING WAVE SWITCH HAVING FET-INTEGRATED CPW LINE STRUCTURE

(75) Inventors: Zuo-Min Tsai, Taipei (TW); Mei-Chao Yeh, Taipei (TW); Huei Wang, Taipei (TW)

(73) Assignee: National Taiwan University, Taipei (TW)

( * ) Notice: Subject to any disclaimer, the term of this patent is extended or adjusted under 35 U.S.C. 154(b) by 342 days.

(21) Appl. No.: 11/276,952

(22) Filed: Mar. 18, 2006

(65) Prior Publication Data

US 2007/0216501 A1 Sep. 20, 2007

(51) Int. Cl.
*H01P 1/15* (2006.01)

(52) U.S. Cl. ..... 333/103; 333/262

(58) Field of Classification Search ..... 333/262, 333/103, 104; 200/181; 327/308
See application file for complete search history.

(56) References Cited

U.S. PATENT DOCUMENTS

| | | | | |
|---|---|---|---|---|
| 5,159,297 | A * | 10/1992 | Tateno | 333/104 |
| 6,801,108 | B2 * | 10/2004 | Wang et al. | 333/262 |
| 2007/0024389 | A1 * | 2/2007 | Mizutani | 333/104 |
| 2007/0030101 | A1 * | 2/2007 | Mizutani | 333/262 |
| 2007/0273457 | A1 * | 11/2007 | Mizutani | 333/103 |

* cited by examiner

*Primary Examiner*—Benny Lee
*Assistant Examiner*—Alan Wong

(57) ABSTRACT

A traveling-wave switch includes a FET-integrated Coplanar Waveguide (CPW) line structure. The FET-integrated CPW line structure incorporates a transistor, a signal line, and the ground, that can be used to eliminate the limitations imposed by the parasitic inductance of the prior art on the operation frequency of the switch. The signal line is connected directly to the drain of the transistor, eliminating the parasitic inductance caused by the connection wire between the signal line and the transistor. The source of the transistor is coupled directly to the ground of the coplanar waveguide line, thus eliminating the parasitic inductance between the transistor and ground, and raising the operation frequency of the switch.

8 Claims, 11 Drawing Sheets

(a)

(b)

TRAVELING WAVE SWITCH HAVING FET-INTEGRATED CPW LINE STRUCTURE

BACKGROUND OF THE INVENTION

1. Field of the Invention

The present invention relates to a traveling wave switch, and in particular to a traveling wave switch having FET-integrated CPW (coplanar waveguide) line structure.

2. The Prior Arts

In general, in wireless communication, the transmission/receiving switches play an important role in changing the channels of the signals of radio frequency (RF) from a transmitter to a receiver and vise versa. Recently, the switches utilizing the FET devices have become very popular and are widely used, as they can be realized by the standard manufacturing process and they can be integrated easily with other active components, such as the integrated power amplifiers or the low noise amplifiers. In order to raise the operation frequency of the switches thus they can be operated at high frequency, the design of a traveling wave shunt FET switch is proposed. In this design approach, the parasitic capacitance of the transistor and the parasitic inductance of the transmission line can be modeled as the low pass transmission line having specific impedance. Due to their broadband frequency response, thus switches based on traveling-wave concept are designed.

Usually, the operation frequency bandwidth of the traveling wave switch designed based on the traveling wave concept can be increased. However, when the signal frequency is greater than that of the W-band (75-110GHz), the parasitic inductance between the transistor in the switch and the signal line will restrict the operation frequency of the switch and its performance. In order to overcome this problem, a special manufacturing process of Hetero-junction FET (HJFET) is proposed, so that the operation frequency of the switch can be raised to 110GHz.

Regarding the standard manufacturing process of this type of traveling wave switch, a FET-integrated transmission line is proposed, which is used to eliminate the parasitic inductance between the transistor and signal line of this special structure. However, in this particular layout, the parasitic inductance between the device and ground still exists due to the existence of the via holes, and that will restrict the operation frequency of the traveling wave switch, and the details of which will be described in conjunction with an example as follows.

Firstly, please refer to FIG. 1 for a circuit diagram of an ordinary traveling wave switch of the prior art. As shown in FIG. 1, a resistor 13 is provided to control the voltage applied to the gate of a transistor 12, thus achieving the switching of the signal transmitted in the signal line 11 by turning on or turning off the transistor 12.

Next, referring to FIGS. 2(*a*) and 2(*b*). FIG. 2(*a*) is a schematic diagram of the structure of the traveling wave switch of the prior art. FIG. 2(*b*) is a circuit diagram of an equivalent circuit of the traveling wave switch shown in FIG. 2(*a*). As shown in FIG. 2(*b*), a parasitic inductance lp is created by a connection wire between the signal line 11 and the transistor 12; also, a parasitic inductance is created between the transistor 12 and ground due to the existence of a via hole 14 there-between, thus imposing restrictions on the switch so that its operation frequency can not be increased.

Then, referring to FIGS. 3(*a*) and 3(*b*). FIG. 3(*a*) is a schematic diagram of the structure of a traveling wave switch having FET-integrated transmission line of the prior art, which is an improvement of the traveling wave switch as shown in FIG. 2(*a*). FIG. 3(*b*) is a circuit diagram of the equivalent circuit of the traveling wave switch shown in FIG. 3(*a*). As shown in FIG. 3(*b*), the signal line 11 is connected directly to the source S of transistor 12, and the drain of the transistor is connected to ground. As such, in this configuration, the parasitic inductance lp created by the connection wire between the signal line 11 and the transistor 12 can be neglected. However, the parasitic inductance between the transistor 12 and ground still exists, that imposes a restriction on the traveling switch so that its operation frequency can not be increased.

SUMMARY OF THE INVENTION

In order to overcome the problem and restriction of the operation frequency of the traveling wave switch of the prior art, the present invention discloses a traveling wave switch utilizing a FET-integrated coplanar waveguide (CPW) line structure. Through the application of such a switch, the parasitic inductances between the signal line and the transistor and between the transistor and ground can be effectively eliminated, thus achieving the raise of the operation frequency and performance of the traveling wave switch, and the reduction of the chip area it requires.

In addition, a Single Pole Single Throw (SPST) traveling wave switch and a Single Pole Double Throw (SPDT) traveling wave switch may be designed and manufactured by making use of the above-mentioned traveling wave switch of the present invention as a basic unit. Through actual test and application, it is verified to have superior quality and performance. In this respect, it is verified that the Single Pole Single Throw (SPST) traveling wave switch and the Single Pole Double Throw (SPDT) traveling wave switch thus produced can both achieve the operation frequency of 135 GHz, and having the dimensions of $1.64\times0.42$ mm$^2$ and $1.35\times0.5$ mm$^2$ respectively, that are far less than the dimension of $1.45\times1$ mm$^2$ of the similar traveling wave switch of the prior art.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which:

FIG. 2(*b*) is a circuit diagram of an equivalent circuit of the traveling wave switch shown in FIG. 2(*a*);

FIG. 3(*b*) is a circuit diagram of the equivalent circuit of the traveling wave switch shown in FIG. 3(*a*);

FIG. 4(*b*) is a circuit diagram of the equivalent circuit of the switch of FIG. 4(*a*);

FIG. 5(*b*) is a circuit diagram of the equivalent circuit of the transistor used in the traveling wave switch of FIG. 5(*a*);

FIG. 6(*b*) is a circuit diagram of a SPDT traveling wave switch according to an embodiment of the present invention;

DETAILED DESCRIPTION OF THE PREFERRED EMBODIMENT

The purpose, construction, features, functions and advantages of the present invention can be appreciated and understood more thoroughly through the following detailed description with reference to the attached drawings.

In the following illustration, the traveling switch having FET-integrated coplanar waveguide (CPW) line structure will be described in detail with reference to the attached drawings.

Figure 4:
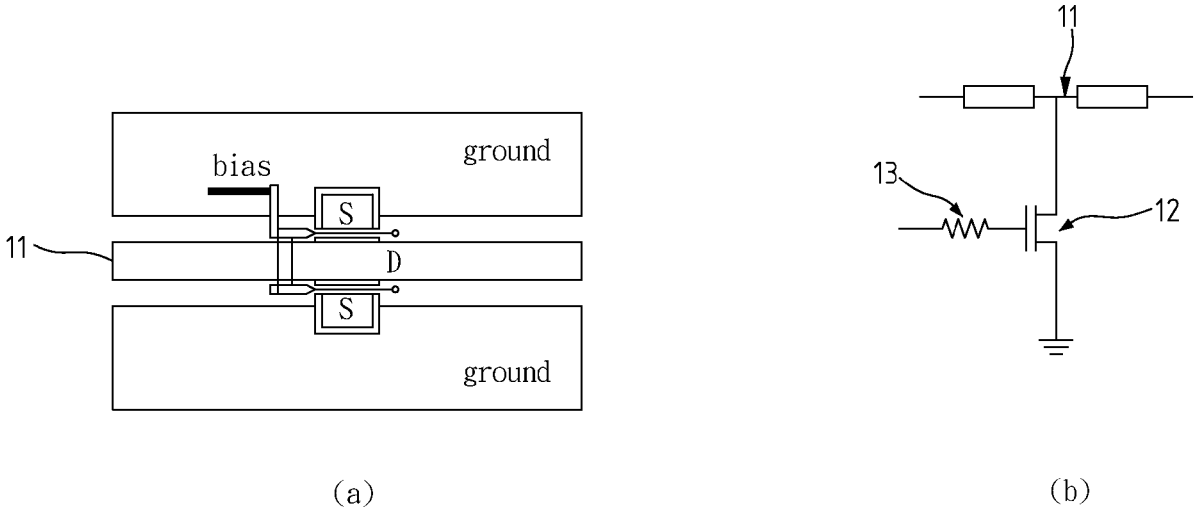
FIG. 4(*a*) is a schematic diagram of the structure of a traveling wave switch having FET-integrated CPW line structure of the present invention.

Firstly, the concept of FET-integrated coplanar waveguide line will be explained. Please refer to FIGS. 4(*a*) and 4(*b*). FIG. 4(*a*) is a schematic diagram of the structure of a traveling wave switch having FET-integrated CPW line structure of the present invention, FIG. 4(*b*) is a circuit diagram of the equivalent circuit of the switch of FIG. 4(*a*). As shown in FIG. 4(*b*), since the signal line is connected directly to the drain of the transistor, therefore, the connection wire between the signal line and the transistor can be saved, thus eliminating the parasitic inductance caused by the connection wire between the signal line and the transistor. In addition, since the source of the transistor is coupled directly to the ground of the coplanar waveguide line (the second metallic layer), the parasitic inductance between the transistor and ground is eliminated, hereby raising the operation frequency of the switch.

Figure 5A:
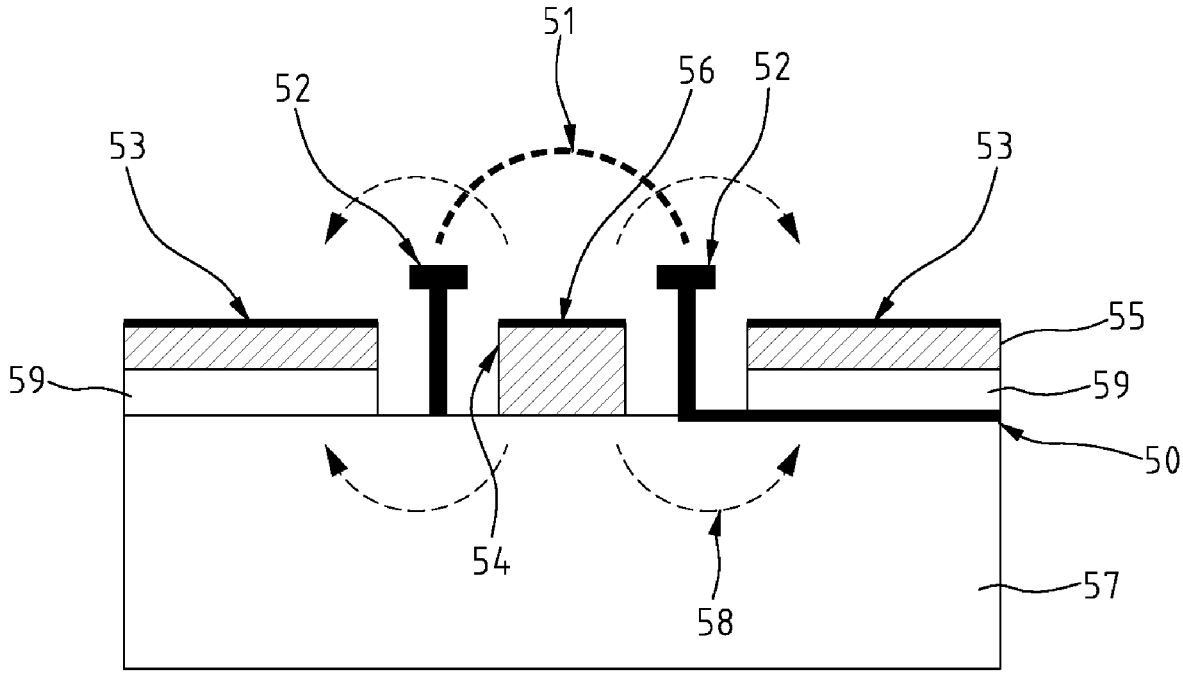
FIG. 5(*a*) is a schematic diagram of a longitudinal cross section of a traveling wave switch having FET-integrated CPW line structure according to an embodiment of the present invention.
Figure 5B:
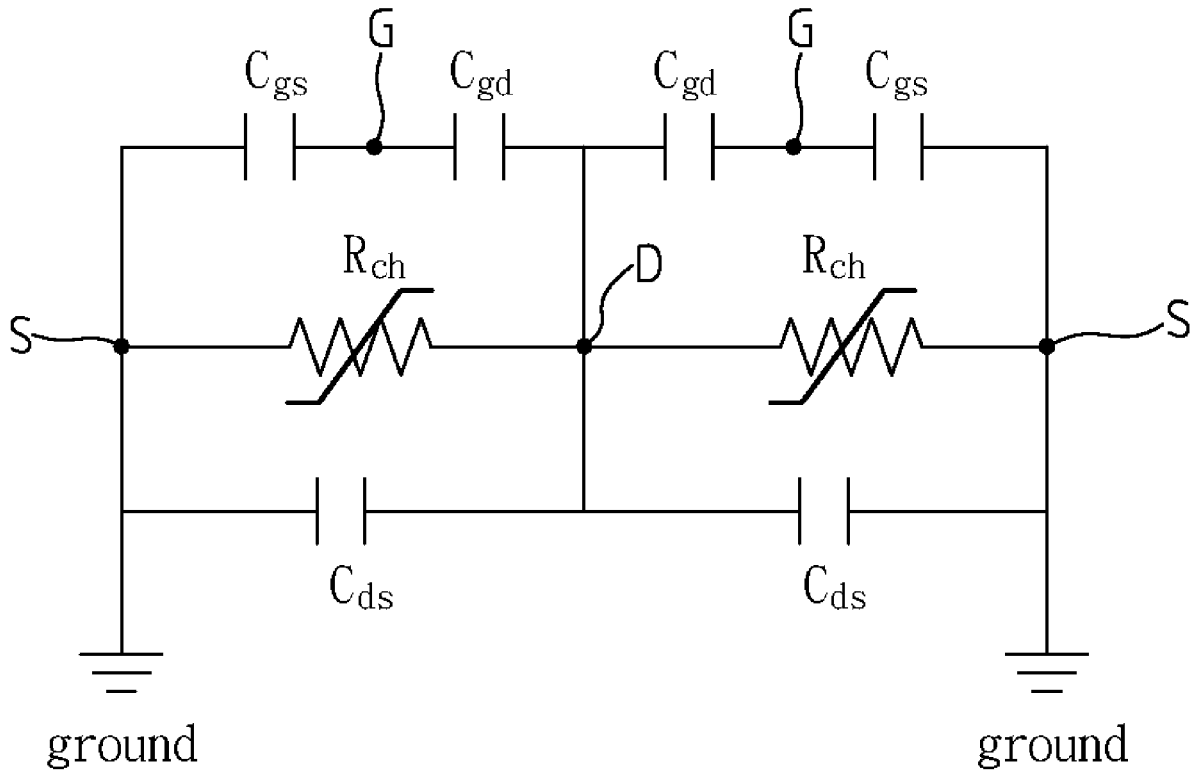

Next, referring to FIG. 5(*a*) for a schematic diagram of a longitudinal cross section of a traveling wave switch having FET-integrated CPW line structure according to an embodiment of the present invention. In the present embodiment, the transistor is integrated into a coplanar waveguide line. As such, the bias circuit of the transistor must be designed by taking special considerations. Thus, in the present invention, the second metallic layer 53 (metal 2) is used to form the ground of the coplanar waveguide line, meanwhile the first metallic layer 51 (metal 1) is used as an air bridge to bridge between the two gates 52, and a large resistor 50 (mesa) is used to run through the second metallic layer 53 to provide a control voltage 58 to the gate 52 of the transistor. In the above-mentioned structure, the second metallic layer 53 is provided on the source 55, the signal line 56 is disposed on the drain 54, and the drain 54 is provided on the substrate 57. Through the application of the circuit layout formed by such a special design, the area occupied by the traveling wave switch having FET-integrated CPW line structure can be effectively and significantly reduced.

In this preferred embodiment of the present invention, a dielectric layer 59 is disposed between the mesa resistor 50 and the source 55 of the transistor.

Figure 1:
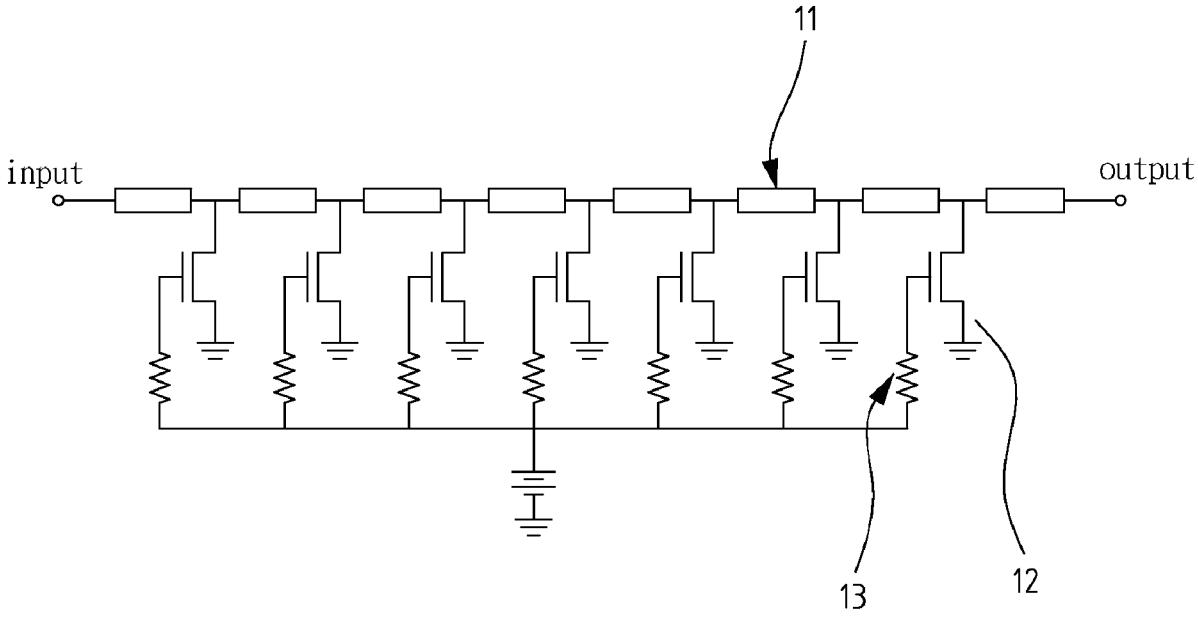
FIG. 1 (Prior Art)
FIG. 1 is a circuit diagram of an ordinary traveling wave switch of the prior art.
Figure 2:
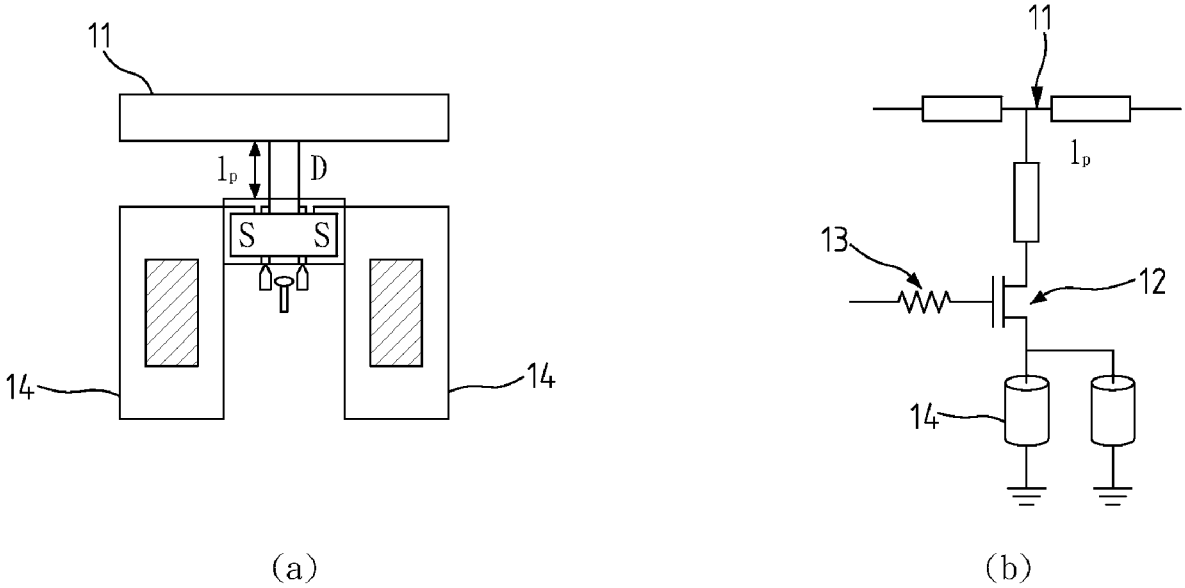
FIG. 2 (Prior Art)
FIG. 2(*a*) is a schematic diagram of the structure of the traveling wave switch of the prior art.
Figure 3:
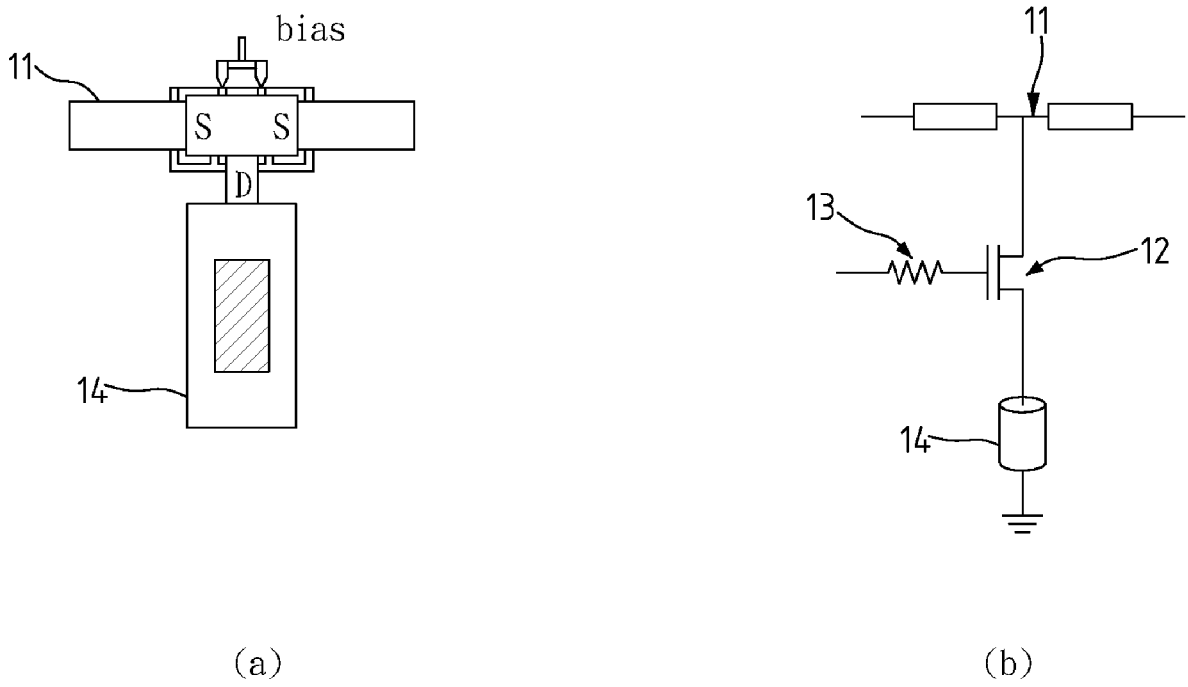
FIG. 3 (Prior Art)
FIG. 3(*a*) is a schematic diagram of the structure of a traveling wave switch having FET-integrated transmission line of the prior art.

Then, referring to FIG. 5(*b*), which shows the circuit diagram of the equivalent circuit of the transistor portion of the traveling wave switch structure of FIG. 5(*a*). Wherein, Rch is the resistance of the channel between the drain and source, which can be varied depending on the voltage between the gate and the source. In the present embodiment, the switch is controlled through varying the voltage between the gate and the source of the transistor. Since there are no additional parasitic inductances from transistor to ground and from signal line to transistor, thus the bandwidth of the switch can be increased significantly. As such, in this embodiment, the design consideration can be reduced to only the capacitance, such as Cgd, Cds, and Cgs, which represent the capacitance between the gate and the drain, the capacitance between the drain and the source, and the capacitance between the gate and the source respectively. From FIGS. 2(*a*) and 2(*b*) it can be observed that the gate bias in the conventional switch and the integrated FET transmission line switch may be easily realized by a resistor, since the signal line and the gate bias are separated by a resistor. For the integrated CPW transmission line, the gate bias is close to the drain and the source, therefore the bias must go through the ground. As shown in FIG. 5(*a*), the two gates are connected by an air bridge, and the high resistance mesa resistor on a different layer from the ground is used for the bias current.

In addition, in the present embodiment, the manufacturing process utilized is: the WIN's 0.15 μm high linearity AlGaAs/InGaAs/GaAs p high-electron-mobility-transistor (pHEMT) monolithic-microwave-integrated-circuit (MMIC) process. Such a HEMT device has a typical unit current gain cutoff frequency ($f_T$) of more than 85 GHz and maximum oscillation frequency (fmax) of greater than 120 GHz at 1.5 V drain bias, with a peak dc transconductance (Gm) of 495 mS/mm. The gate-drain breakdown voltage is 10V, and the gate to source voltage at peak transconductance at 1.5V drain-source voltage is −0.45V. This MMIC process also includes thin-film resistors, MIM capacitors, and spiral inductors, and air-bridges. The wafer can be thinned to 4 mils for the gold plating of the backside, and the reactive ion etching via holes are provided.

The afore-mentioned process is mainly utilized to produce: (1) The traveling wave switch having FET-integrated CPW line structure, (2) the single-pole-single-throw (SPST) switch realized by series-connecting a plurality of such a traveling wave switch having FET-integrated CPW line structure, and (3) the single-pole-double-throw (SPDT) switch realized by shunt-connecting a plurality of such a traveling wave switch having FET-integrated CPW line structure in a slightly different manner.

Figure 6A:
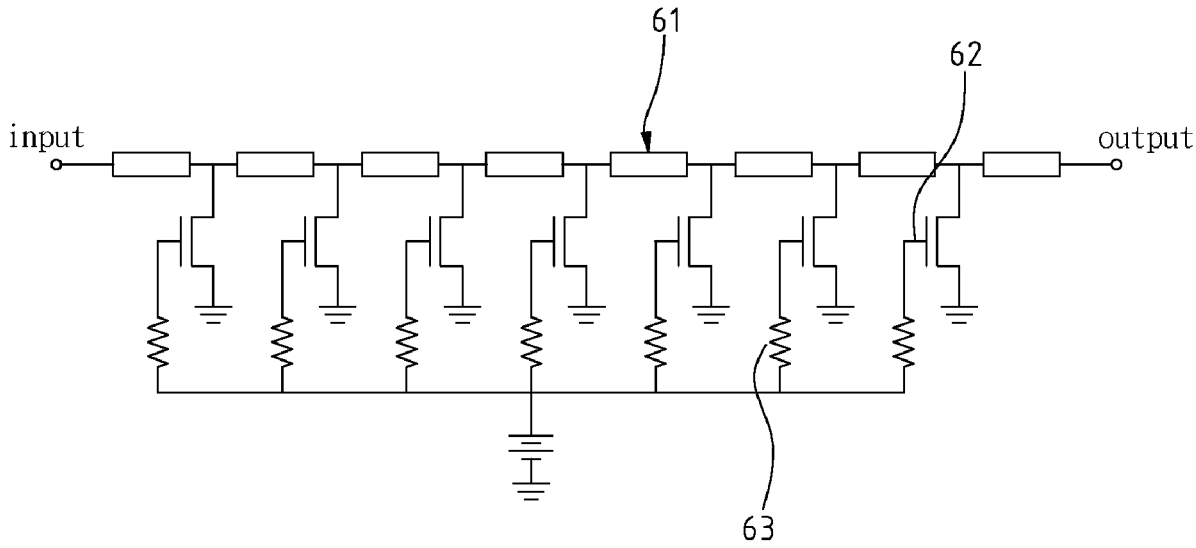
FIG. 6(*a*) is a circuit diagram of a SPST traveling wave switch according to an embodiment of the present invention.
Figure 6B:
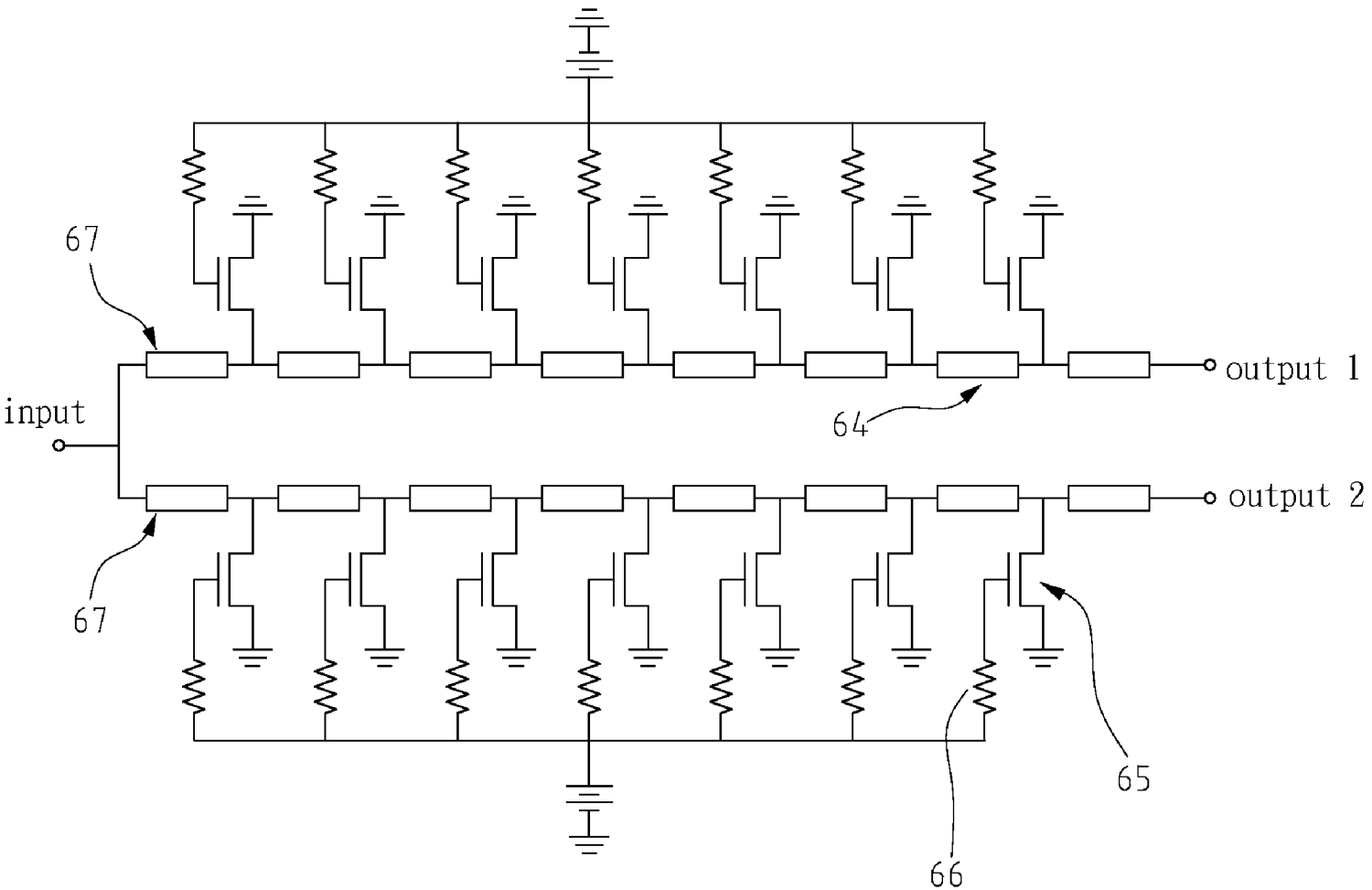

In the following, the circuit layouts of SPST traveling wave switch and SPDT traveling wave switch of the present invention will be described in detail. Please refer to FIG. 6(*a*) for a circuit diagram of a SPST traveling wave switch according to an embodiment of the present invention. As shown in FIG. 6(*a*), the single-pole-single-throw (SPST) traveling wave switch is composed of 7 common source transistors and high impedance transmission lines. In the present embodiment, the SPST traveling wave switch includes: a signal line 61, seven transistors 62, and seven resistors 63.

For the realization of the FET integrated CPW line, the 2-finger transistors are utilized. The finger width of each transistor is determined by the trade-off between bandwidth and insertion loss. The length and impedance of the transmission line are selected by the design procedure. The transistors exhibit a shunt capacitor when the gate voltage is −2V as the switch turns on. On the other hand, the transistors provide shunt resistors to ground when the gate voltage is 0 V. Next, please refer to FIG. 6(*b*) for a circuit diagram of a SPDT traveling wave switch according to an embodiment of the present invention. As shown in FIG. 6(*b*), the SPDT traveling wave switch consists of two SPST traveling wave switches and two quarter wave length transformers 67. The low-end operation frequency is limited by the quarter wavelength transmission line that forms the quarter wavelength transformer 67. In the above-mentioned structure, a signal line 64, fourteen transistors 65, and fourteen resistors 66 are included.

Figure 7:
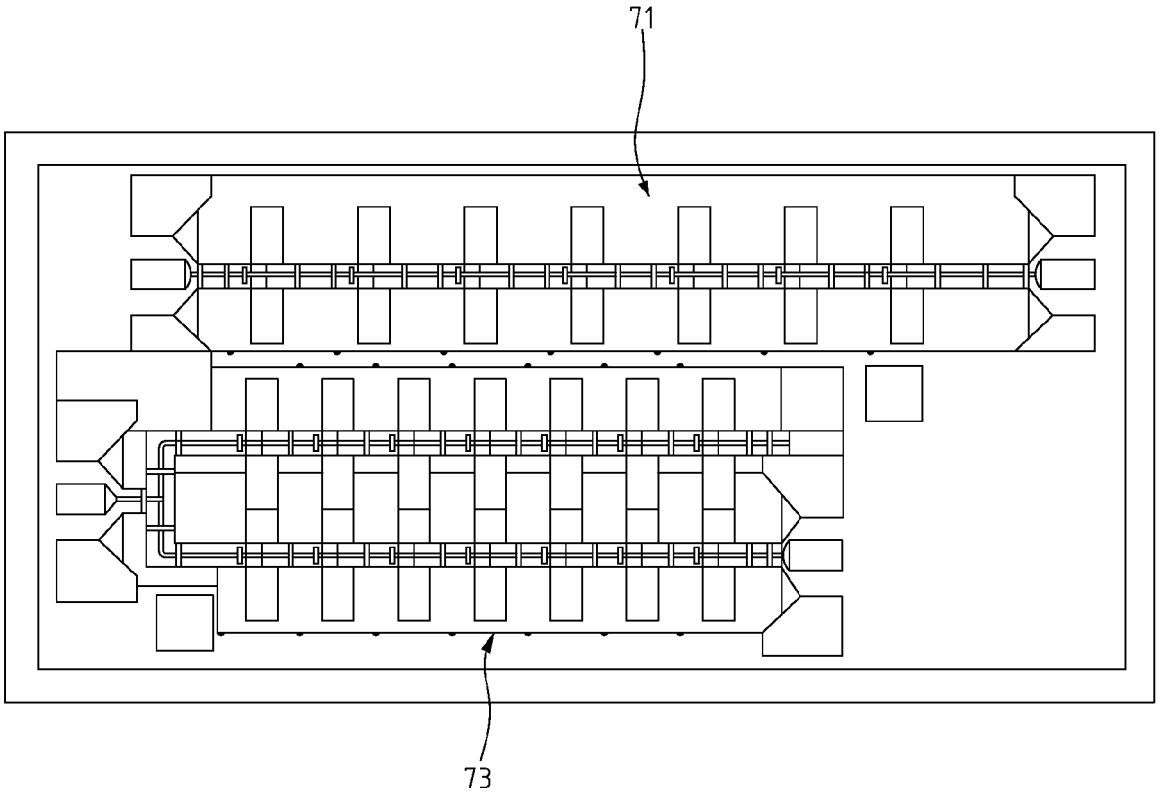
FIG. 7 is a schematic diagram of die for both the SPST and SPDT switches according to an embodiment of the present invention.

For the single mode operation of CPW line, air bridges are used to suppress the odd mode of the CPW line. Via holes are placed between top and bottom ground planes to prevent the parallel plate mode. All the distributed elements are characterized by the 3D full wave electro-magnetic (EM) simulation. FIG. 7 shows the schematic diagram of die for both the SPST and SPDT switches, with the total chip size of 2×1 $mm^2$. On the top of the diagram is the SPST switch 71, which is 1.64×0.42$mm^2$. At the bottom of the diagram is a SPDT switch 73 having a chip size of 1.35×0.5$mm^2$. For on-wafer testing consideration, since two GSG probes cannot be placed on the same side of the SPDT chip 73, the second output port is terminated by a 50 Ω termination.

Figure 8:
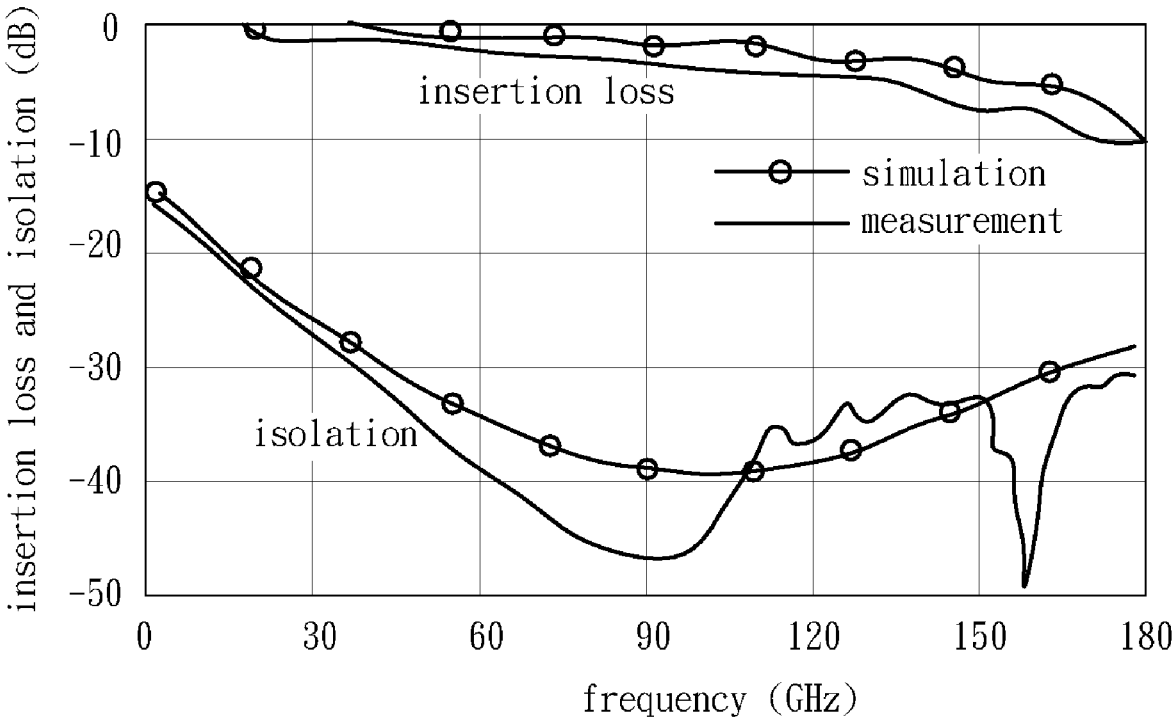
FIG. 8 is a curves comparison diagram of insertion loss and isolation (dB) vs. frequency (GHz) for the measured and simulated results of the SPST switch according to an embodiment of the present invention.
Figure 9:
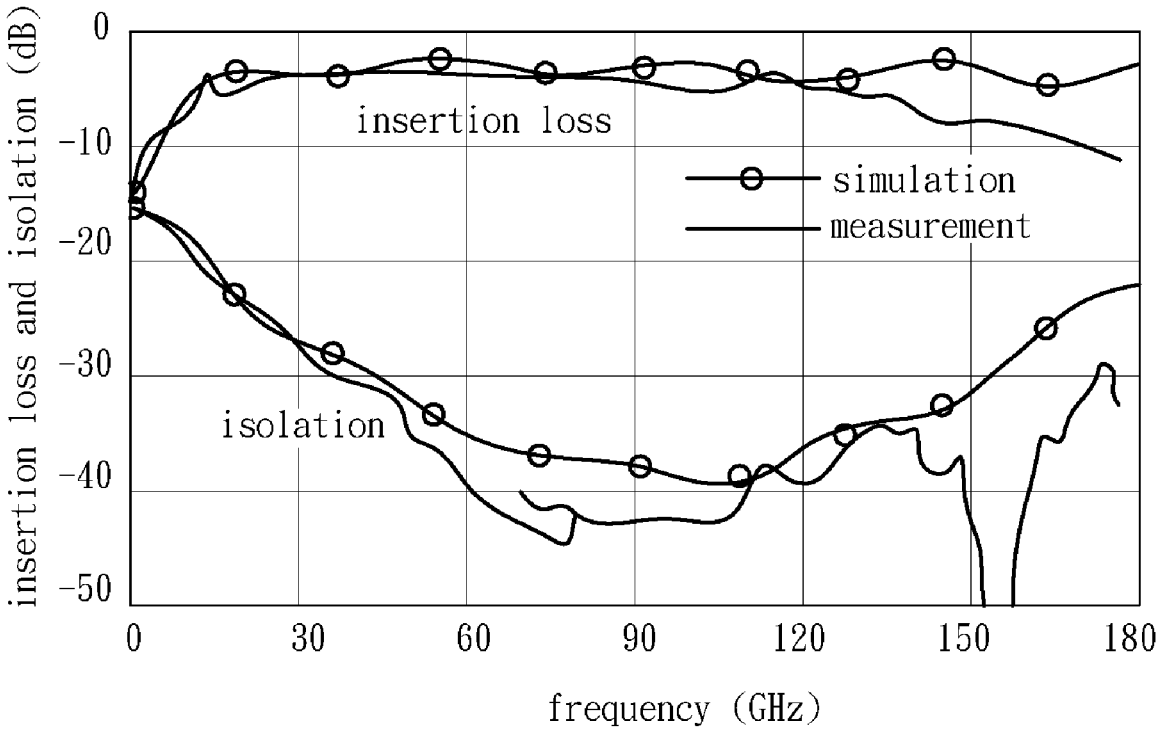
FIG. 9 is a curves comparison diagram of insertion loss and isolation (dB) vs. frequency (GHz) for the measured and simulated results of the SPDT switch according to an embodiment of the present invention.

In the present embodiment, the SPST and SPDT switches are measured by the on-wafer test. Wherein, four different frequency ranges (45 MHz to 50 GHz V-band (50-75 GHz), W-band, and D-band) are measured by the network analyzer with different test sets. FIG. 8 is a curves comparison diagram of insertion loss and isolation (dB) vs. frequency (GHz) for the measured and simulated results of the SPST switch according to an embodiment of the present invention. As shown in FIG. 8, the SPST switch achieves an insertion loss of 2.5 dB at 75 GHz, 4.1 dB at 110 GHz, and 5.0 dB at 135 GHz respectively. It may also achieve an isolation of more than 30 dB. FIG. 9 is a curves comparison diagram of insertion loss and isolation (dB) vs. frequency (GHz) for the measured and simulated results of the SPDT switch according to an embodiment of the present invention. As shown in FIG. 9, the SPDT switch achieves an insertion loss of 4.1 dB at 75 GHz, 5 dB at 110 GHz, and 6 dB at 135 GHz respectively. The isolation of the SPDT switch is also higher than 30 dB from 40 GHz to 135 GHz. These measurements agree with the simulation results well.

Finally, referring to Table 1, which indicates the various operation functions and characteristics of the millimeter wave switch utilizing the traveling wave concept of the present invention. In the column it indicates the transistor, operation frequency (GHz), insertion loss (dB), isolation (dB), input/output (I/O) and chip size ($mm^2$) for the traveling wave switches utilizing FET-integrated CPW Line Structure of the present invention.

Table 1 lists the previously reported switches by using traveling wave concept. It can be observed that the operation frequency is limited below 100 GHz except [4]. In [4], the problem of the parasitic inductance is eliminated by a special process of HJFET. In [6], the high frequency performance is achieved by the integrated FET transmission line structure, but the limitation of the frequency performance caused by the via hole inductance still exists. The advantages of the reduced chip size of the new integrated FET CPW line structure of the present invention can also be observed in Table 1. Since there are no additional via holes or transmission lines utilized for the connection between the transistors and the signal lines, compact chip sizes of 1.64×0.42 $mm^2$ and 1.35×0.5 $mm^2$ can be achieved for the SPST and SPDT respectively.

Summing up the above, the present invention discloses a traveling wave switch having FET-integrated CPW line structure, which can be used as a high frequency switch in the transmission/reception conversion process of the antenna for the RF signals in the RF electromagnetic wave communication, thus achieving the functions and objective of the RF signal switching. Through the application of the traveling wave switch of the present invention, the parasitic inductances between the transistor and signal line and the transistor and ground of the prior art traveling wave switch can be eliminated, thus effectively increasing the operation frequency of the switch and reducing the chip area required, hereby reducing the production cost significantly. Through the utilization of the traveling wave switch of the present invention, the operation frequency can be raised to exceed 100 GHz, and its bandwidth can be increased from dc to 135 GHz.

In addition, the traveling wave switch mentioned above may be utilized as the constituting unit in the design and manufacturing of SPST traveling wave switch and SPDT traveling wave switch. Through real test and application, they are verified as having superior quality and performance. For instance, as verified by experiments, the operation frequencies of the SPST traveling wave switch and the SPDT traveling wave switch may both reach 135 GHz, with their sizes reduced to 1.64×0.42 $mm^2$ and 1.35×0.5 $mm^2$ respectively, which are far less than 1.45×1 $mm^2$ of the similar traveling wave switch of the prior art.

From the above description it is evident that, the functions and performances of the traveling wave switch having FET-integrated CPW line structure, the SPST traveling wave switch and the SPDT traveling wave switch disclosed by the present invention, are far more superior to those of the similar products of the prior art. Therefore, the present invention does have application value in the industry, and in conformity with the patent requirements.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements, which are within the scope of the appended claims.

TABLE 1

| | Recently reported performance of millimeter-wave switches using traveling-wave concept | | | | | |
|---|---|---|---|---|---|---|
| Device | Frequency (GHz) | Insertion loss (dB) | Isolation (dB) | Input/output | Chip size ($mm^2$) | Ref. |
| HEMT | 15-80 | <3.6 | >25 | SPDT | 1.5 × 1.5 | 「1」 |
| HEMT | DC-60 | <3 | >24 | SPDT | 1 × 1 | 「1」 |

TABLE 1-continued

| Device | Recently reported performance of millimeter-wave switches using traveling-wave concept | | | | | |
|---|---|---|---|---|---|---|
| | Frequency (GHz) | Insertion loss (dB) | Isolation (dB) | Input/output | Chip size ($mm^2$) | Ref. |
| HEMT | DC-80 | <3 | >24 | SPST | 1 × 0.75 | 「1」 |
| MESFET | 20-40 | <2 | >23 | SPDT | 1.25 × 1.25 | 「2」 |
| MESFET | DC-40 | <3 | >23 | SPDT | 0.84 × 1.27 | 「2」 |
| MEHT diode | 23-78 | <4 | >25 | SPDT | 1.65 × 1.33 | 「3」 |
| HJFET | DC-110 | <2.55 | >22.2 | SPST | 0.85 × 0.45 | 「4」 |
| HEMT | 15-50 | <3.1 | >40 | SPDT | 1.5 × 2 | 「5」 |
| HEMT | 40-85 | <2 | >30 | SPDT | 1.45 × 1 | 「6」 |
| HEMT | DC-110 | <4 | >25 | SPST | 1.64 × 0.42 | Present |
| | DC-135 | <5 | >25 | | | invention |
| HEMT | 20-110 | <5 | >23 | SPDT | 1.35 × 0.5 | Present |
| | 15-135 | <6 | >20 | | | invention |

What is claimed is:

1. A traveling wave switch comprising:

a coplanar waveguide line structure formed by a first metal layer, a second metal layer, and a signal line, providing a switching channel for signals passing through the traveling wave switch; and a field effect transistor composed of a gate, a drain, and a source, wherein the drain is electrically connected to the signal line, and the signal line directly passes through the drain of the field effect transistor, the source is electrically connected to a ground of the coplanar waveguide line structure, the gate is connected to the first metal layer through an air bridge, and connected to the gate by passing the ground of the coplanar waveguide line structure through a mesa resistor, and is used to switch the signals passing through the traveling wave switch;

wherein the ground of the coplanar waveguide line structure is the second metal layer.

2. The traveling wave switch as claimed in claim 1, wherein the traveling wave switch has an operating frequency greater than 100 GHz and an operating bandwidth from dc to 135 GHz.

3. The traveling wave switch as claimed in claim 1, wherein the traveling switch is a single-pole-single-throw (SPST) switch.

4. The traveling wave switch as claimed in claim 3, wherein the single-pole-single-throw (SPST) switch comprises:

a high impedance transmission line whose length and impedance are determined through a specific design process; and seven two-finger common source shunt-transistors, which are used to produce a FET-integrated coplanar waveguide line, wherein each shunt-transistor has a finger width determined by trade-off between bandwidth and insertion loss of the traveling wave switch, and acts as a shunt capacitor when the shunt-transistor has a gate voltage of −2V, and as a shunt resistor to the ground when the gate voltage is 0V.

5. The traveling wave switch as claimed in claim 3, wherein operation frequency of the single-pole-single-throw (SPST) switch has an operation frequency reaching 135 GHz, and occupies a chip area of 1.64×0.42 $mm^2$.

6. The traveling wave switch as claimed in claim 1, wherein the traveling switch is a single-pole-double-throw (SPDT) switch.

7. The traveling wave switch as claimed in claim 6, wherein the single-pole-double-throw (SPDT) switch includes two single-pole-single-throw (SPST) switches and two quarter wavelength transformers each being formed by a quarter wavelength transmission line, and a low-end operation frequency of the traveling wave switch is limited by the quarter wavelength transmission line.

8. The traveling wave switch as claimed in claim 6, wherein the single-pole-double-throw (SPDT) switch has an operating frequency reaching 135 GHz, and occupies a chip area of 1.35×0.5 $mm^2$.

* * * * *